United States Patent [19]

Miyamoto

[11] Patent Number: 4,480,517

[45] Date of Patent: Nov. 6, 1984

[54] BACK-SPLITTING APPARATUS FOR USE IN PRODUCTION OF BOOKS

[75] Inventor: Eiji Miyamoto, Kanaza, Japan

[73] Assignee: Marumiya Shoko Co., Ltd., Japan

[21] Appl. No.: 397,694

[22] Filed: Jul. 13, 1982

[30] Foreign Application Priority Data

Jul. 15, 1981 [JP] Japan ..... 56-110579

[51] Int. Cl.[3] ..... B26D 5/34

[52] U.S. Cl. ..... 83/210; 83/278; 83/437; 83/614; 83/925 A

[58] Field of Search ..... 83/100, 209, 210, 278, 83/437, 614, 925 A

[56] References Cited

U.S. PATENT DOCUMENTS 758,156 4/1904 Taylor ..... 83/925 A

*Primary Examiner*—James M. Meister

*Attorney, Agent, or Firm*—Andrus, Sceales, Starke & Sawall

[57] ABSTRACT

Back-splitting apparatus for use in the production of books such as account books, notebooks, textbooks and the like for separating a block of stacked sheets of paper, bound together at one side by gluing and constituting a plurality of books, into individual books. A plurality of projection pieces are provided at one sides of the final sheets of the respective books of the block. A suction member is disposed at the position faced with one of the projection pieces, and a pawl member is disposed movably to the lower portion of the suction member. The block of stacked sheets of paper is separated into individual books accurately by advancing a back-splitting cutter knife into the back surface side of the projection piece interposed between the suction member and the pawl member. Thus, this apparatus can effectively separate a block of stacked sheets of paper made of thick and extremely thin sheets.

5 Claims, 4 Drawing Figures

BACK-SPLITTING APPARATUS FOR USE IN PRODUCTION OF BOOKS

BACKGROUND OF THE INVENTION

This invention relates to back-splitting apparatus for use in the production of books such as account books, notebooks, textbooks and the like books and particularly for separating a block of stacked sheets of paper, bound together at the back or top by gluing and constituting a plurality of books into individual books and, more particularly, to improvement in the back-splitting apparatus for use in the production of books.

A most important point where a block of stacked sheets of paper is to be mechanically separated into individual books involves introducing introduce a cutter knife for separating the block of stacked sheets of paper along the back glued surface of the block of stacked sheets to produce individual books irrespective of the thickness of the sheets. The present inventor has proposed a mechanism for separating mechanically a block of stacked sheets of paper, bound together and constituting a plurality of books into individual books with a suction member in the prior British Pat. No. 1 528 855 as a result of studies for a long period of time. The present invention provides a back-splitting apparatus for use in the production of books which has further been improved from the prior invention disclosed.

SUMMARY OF THE INVENTION

It is therefore an object of this invention to provide back-splitting apparatus for use in the production of books which can further effectively introduce a cutter knife into the back surface of a block of stacked sheets of paper, bound together at the back or top by gluing and constituting a plurality of books to separate the block into individual books.

Another object of this invention is to provide back-splitting apparatus for use in the producton of books which can effectively separate a block of stacked sheets of paper made of thick and thin sheets for notebooks, textbooks and account books into individual books.

Still another object of this invention is to provide back-splitting apparatus for use in the production of books which can mechanically separate a block of stacked sheets of paper made of extremely thin sheets by effectively interposing a projection piece provided at the final block of stacked sheets corresponding to one book between a suction member and a pawl member.

BRIEF DESCRIPTION OF THE DRAWINGS

The above and other related objects and features of the invention will be apparent from a reading of the following description of the disclosure found in the accompanying drawings and the novelty thereof pointed out in the appended claims.

DESCRIPTION OF THE PREFERRED EMBODIMENTS

Figure 1:
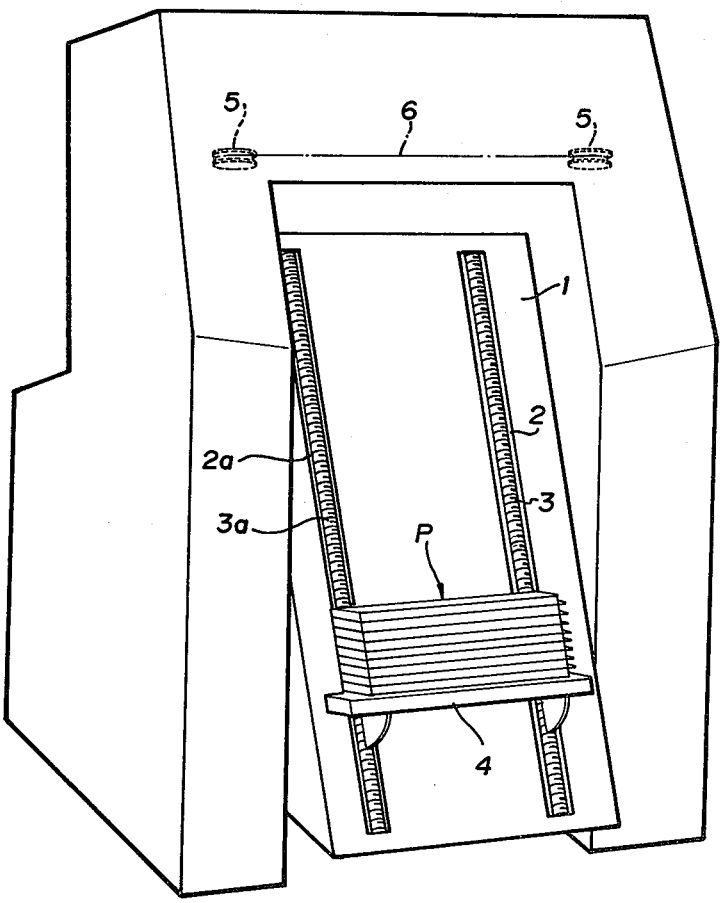
FIG. 1 is a perspective view of one preferred embodiment of back-splitting apparatus according to the present invention.
Figure 2:
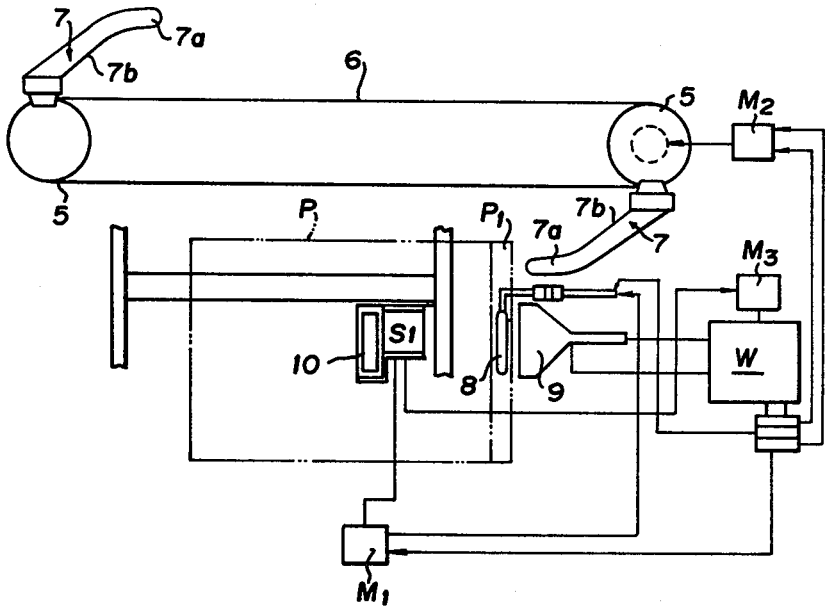
FIG. 2 is a view showing the schematic front side of a back-splitting mechanism disposed at the end of a table and the block diagram of the operating relationship of respective sensors of the back-splitting apparatus of the invention.
Figure 3:
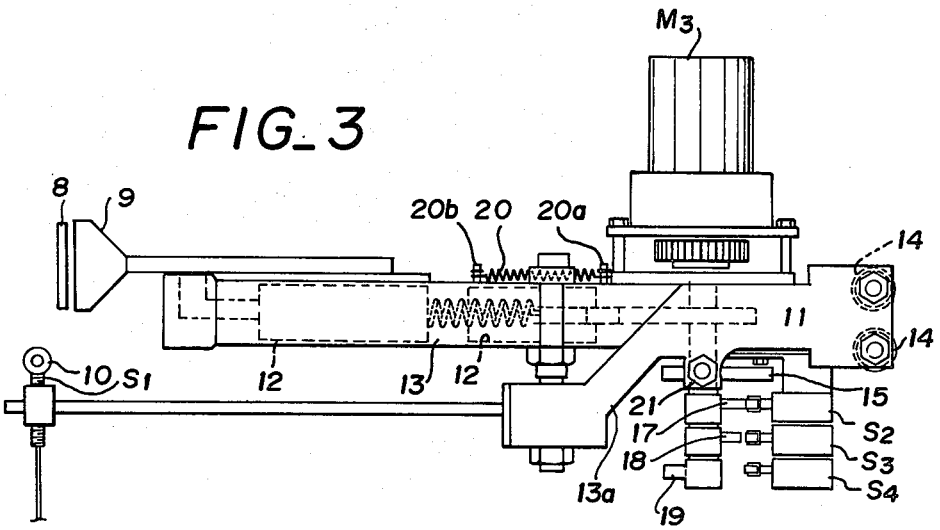
FIG. 3 is a plan view of the operating mechanism of a pawl member provided at the back-splitting apparatus of the invention.
Figure 4:
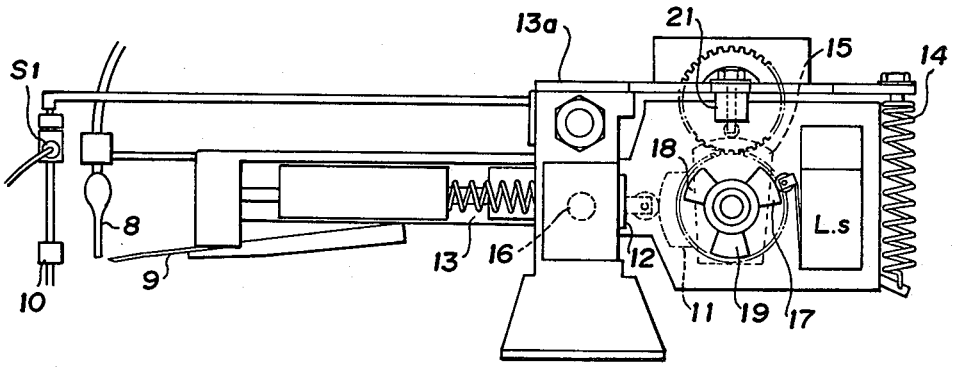
FIG. 4 is a side view of the operating mechanism shown in FIG. 3.

The present invention will now be described in more detail with respect to the preferred embodiments shown in the accompanying drawings. A block P of stacked sheets of paper are to be separated into individual books by the back-splitting apparatus of the this invention. The stacked sheets are bound together at one edge such as at the back or top, e.g., by gluing, and the respective sheets of the binding surface of the block for each individual book respectively include a projection piece having a width of approx. 7 mm and projecting from one side thereof toward the other sheet.

In the back-splitting apparatus, a rectangular table 1 supports a block P of stacked sheets and is inclined upwardly from a rear edge to a front edge thereof, and slits 2, 2*a* are perforated in the table 1 from the lower end to the upper end thereof in the vicinity of both sides of the table 1. At the back sides of the table 1, threaded rods 3, 3*a* respectively are mounted in the slits 2, 2*a*, which rods are driven by a first drive motor $M_1$.

On the front surface of the table 1 is disposed a supporting plate 4 for supporting the block P of the stacked sheets of paper on the table 1, which plate 4 is connected via connecting members at both sides through the slits 2, 2*a* to the threaded rods 3, 3*a*. With this structure, the supporting plate 4 is constructed to elevationally slidably move via the rods 3, 3*a* on the table 1 by the operation of the first drive motor $M_1$.

Above the end face of the table 1 are arranged gears 5, 5 in the vicinity of both sides of the table 1, on which a chain 6 is engaged and is rotated via the gears 5, 5 over the entire width of the table by a second drive motor $M_2$.

The chain 6 is provided with two cutter knives 7 spaced at an equal interval for separating the block P of stacked sheets of paper into individual books. The knife 7 is oriented at an acute angle with respect to the rotating direction of the chain 6.

On the other hand, above the lower end of the table 1 is disposed a movable member 10 which is engaged and pressed against the top surface sheet of the block P of stacked sheets of paper and is thus moved when the block P is lifted to the upper end of the table 1 via the supporting plate 4. The member 70 is constructed to return to the initial position by its own weight when the block P of stacked sheets of paper is removed.

At the side of the movable member 10 is disposed a first sensor $S_1$ which detects the moving distance of the movable member 10 and which closes ON upon the starting of the moving of the movable member 10 and opens OFF when the movable member 10 moves at a predetermined distance, i.e., when the block P of stacked sheets of paper is lifted the distance corresponding to the thickness of one book. The sensor $S_1$ is so electrically connected to the drive motor $M_1$ that, when the sensor $S_1$ turns OFF, the drive motor $M_1$ is stopped. More particularly, when the block P of stacked sheets of paper is projected upwardly from the end of the table 1 at the distance corresponding to the thickness of one book and is thus lifted upwardly at the distance, the motor $M_1$ is stopped, so that the block P of stacked sheets of paper is held stationary for cutting by the introduction of the cutter knife 7 into the binding surface of the block P of stacked sheets of paper to be separated into individual books.

A projection piece $P_1$ is provided at one side of the binding surface of the block P formed at the bound edges of the sheets of paper. At the position in the vicinity to one side of the upper end of the table i.e., at the position where the block P of stacked sheets of paper is lifted forward the end of the table 1 by movement of the supporting plate 4, a suction member 8 is located to create a suction force on the projection piece $P_1$. The suction member 8 is so connected to a suction pump (not shown) as to create the suction force in cooperation with the drive of the first drive motor $M_1$.

In the vicinity of the suction member 8, a pawl member 9 is mounted. The pawl member 9 is formed substantially in a rectangular shape and is connected to an operating mechanism W, which will be described in greater detail, to telescope under the suction opening of the suction member 8.

The operating mechanism W has a third drive motor $M_3$ which is electrically connected to the sensor $S_1$ and is energized when the sensor $S_1$ is turned OFF. An eccentric cam 11 is secured to a drive gear shaft mounted on the drive shaft of the drive motor $M_3$.

The one end of a rod 12 is secured to the pawl member 9 and is in contact with the eccentric cam 11. The rod 12 is movably mounted in a supporting frame 13. A spring coupling member 20*a* is provided at the frame 13, and a spring coupling member 20*b* is provided on the rod 12 which is pulled always toward the cam 11 by a spring 20 coupled to the spring coupling member 20*a* and 20*b*. Coupling member 20*b* is movable along the slot formed at the side of the frame 13. The end of the rod 12 is projected from the slot formed at the side of the frame 13 to engage the pawl member 9.

At the rear end, a frame 13*a* is coupled to the frame 13 by a compression spring 14. The frames 13, 13*a* are constructed to be relatively and elevationally or vertically movable around a shaft 16. The frame 13*a* serves as a fulcrum for operation of the spring 14.

Another cam 15 is mounted on the driven gear shaft and is in contact with a coupling member 21 secured to the side of the frame 13*a*. Coupling member 21 is constructed to elevationally move the end of the frame 13 as described above when the cam 15 is rotated. When the frame 13 is elevationally moved, the rod 12 in the frame 13 and the pawl member 9 which is secured to the end of the rod 12 are similarly elevationally moved.

The eccentric cam 11 and the cam 15 are so formed in shape and designed as to simultaneously rotate via the drive shaft when the drive motor $M_3$ operates. The pawl member 9 moves before the opening of the suction member 8, and to thereafter move is upwardly toward contact with the opening of the suction member 8. Finally, the member 9 returns again to the initial position after the cutter knife 7 finishes the cutting and separating of the block P of stacked sheets of paper into an individual book.

At the end of the gear drive shaft, sensor operating cams 17, 18 and 19 are connected to the end of the gear drive shaft to operate the sensors for detecting the operating states of the operating mechanism. Limit switches $S_2$, $S_3$ and $S_4$ are aligned with and operated by contact of the cams 17, 18 and 19, respectively.

The limit switch $S_2$ is electrically connected to the drive motor $M_2$ to operate the drive motor $M_2$ simultaneously with the pawl member 9 moves downwardly below the suction member and into contact with the suction opening of the suction member.

The limit switch $S_3$ is electrically connected to a suction pump to stop the suction operation of the suction member before the cutting of the block P into one book has been completely finished, i.e., during the operation of the drive motor $M_2$ and the rotation of the cutter knife 7. In this manner, when the block P of stacked sheets of paper is separated into one book completely, the projection piece $P_1$ is not subjected to the suction force and the book thus separated from the block P is dropped from the end of the table 1 to be smoothly fed to the next step.

The limit switch $S_4$ is electrically connected to the start motor $M_1$ to again drive the motor $M_1$ when the cutter knife 7 completes a cut, i.e., when one book is completely separated from the block P of stacked sheets of paper as described above.

The sensor operating cams 17, 18 and 19 are so designed as to operate the pawl member 9 and the drive motors $M_1$, $M_2$ and are mounted on the driven gear shaft mounted on the drive shaft of the drive motor $M_3$.

The cutter knife 7 is, as shown, formed with an outer end guide portion 7*a* and an obtuse rear cutting edge 7*b*. The knife 7 is thus substantially L-shaped and is mounted on the chain 6 in such a manner that the guide portion 7*a* is directed inwardly toward the block P. The cutter knife is thus formed as described above and is operated so that the guide portion 7*a* first moves between the stacked sheets of paper of the block P which are not bound by gluing. When the binding surface of the block P is separated by the insertion of the cutting edge 7*b* of cutter knife 7 between the binding surfaces of the block formed by the bound edge of the sheets of paper, the resistance force and the impact force of the cutting edge 7*b* bearing on the binding surface of the block P of stacked sheets of paper can be absorbed by the guide portion 7*a*. Therefore, the cutter knife 7 can smoothly advance so that the cutter knife and the block P of stacked sheets of paper do not displace with the result that the block P of stacked sheets of paper can be effectively separated into individual books.

The operation of the back-splitting apparatus of the present invention will now be described in more detail with the structure thus constructed as described above.

The block P of stacked sheets of paper, bound together at the back by gluing and constituting a plurality of books is supported by the supporting plate 4 on the table 1, and the drive motor $M_1$ is then driven to move the block P of stacked sheets of paper toward the upper end of the table 1 via the threaded rods 3, 3*a*. When the block P of stacked sheets of paper is thus moved toward the upper end of the table 1, the uppermost surface sheet of the block P is contacted with the movable member 10, which is thus moved.

The sensor $S_1$ is operated simultaneously when the movable member 10 thus starts moving as described above, and is operated to stop the drive motor $M_1$ when the movable member 10 moves at the predetermined distance and hence the distance equal to the thickness of one book of the block P of stacked sheets of paper. At this time the projection piece $P_1$ of the binding surface of the block P is subjected to the suction force of the suction member 8. The drive motor $M_3$ is further operated simultaneously as the sensor $S_1$ turns OFF to operate the operating mechanism. The pawl member 9 thereby moves downwardly of the suction member 8, and then upwardly moved to be intimately moved to contact the suction opening of the suction member 8 and the interposed projection piece $P_1$ held to the suction member 8. When the pawl member 9 has been thus completely moved, the limit switch $S_2$ is operated to energize the drive motor $M_2$, and the cutter knife 7 thus starts rotating. The cutter knife 7 is thus advanced into between the stacked sheets from below of the projection piece $P_1$ interposed between the suction member 8 and the pawl member 9. The cutter knife 7 thus advances into and between the stacked sheets of the block P and moves forwardly and the cutting edge 7*b* separates the back binding surface of the block P. In this case, the suction pump, not shown, to the suction member 8 is stopped by operation of the limit switch $S_3$ before the back binding surface of the block P is completely separated by the cutter knife 7. When the cutter 7 is further advanced to completely separate a book from the block P of stacked sheets of paper, the limit switch $S_4$ will operate to again operate the drive motor $M_1$ and to simultaneously return the pawl member 9 to the initial position. The book thus separated has a thickness corresponding to that of one book and is fed to the next step as by dropping from the upper end of block P, and the movable member 10 is automatically returned to the original position engaging the new top of the block P. When the drive motor $M_1$ is again energized, the block P of stacked sheets of paper is again moved upwardly, and the above operation will be repeated. When the above operation is repeated, the block P of stacked sheets of paper, bound at the back by gluing and constituting a plurality of books, is separated into the plurality of individual books. The drive motor is then reversely driven. Thus, the supporting plate is returned to the original lower position on the table, and a new block P of stacked sheets of paper will be placed thereon. Two cutter knives 7 are provided at the chain 6 so that, when one cutter knife 7 finishes the separating work of the block of stacked sheets of paper into one book, the other cutter knife will be disposed at the starting position for next separating the block P adjacent to the suction member 8.

Since the back-splitting apparatus of this invention is thus constructed and operated as described above, it can mechanically separate the block of stacked sheets of paper into individual books which has been manually performed heretofore, can effectively insert the cutter knife into between the binding surfaces of the stacked sheets to be separated into individual books by effectively interposing the projection piece formed at the final sheet of one book between the suction member and the pawl member, and can reliably separate the block P of stacked sheets of paper, even if made of thick or extremely thin sheets of paper.

What is claimed is:

1. Back-splitting apparatus for use in the production of books comprising:

a feeding mechanism having a back-splitting station and operable to feed a block of stacked sheets of paper, bound together on at least one side and having an adjacent side and constituting a plurality of books to the back-splitting station, each of said books having a plurality of sheets, a plurality of projection piece provided along said adjacent side of the final sheets of the respective books of the block, a suction member disposed at a position corresponding to one of said projection pieces with said block positioned in alignment with the back-splitting station of said feeding mechanism and operable to draw a projection piece toward the suction member, a pawl member movable to the lower portion of said suction member, said pawl member being constructed to be moved below said suction member and a projection piece adjacent said suction member, an operating mechanism connected to said suction member and said pawl member and operating to interpose one of the projection pieces between said suction member and said pawl member, and a back-splitting cutter knife operable to move into the back surface side adjacent said projection piece interposed between said suction member and said pawl member for separating the block of stacked sheets of paper into an individual book.

2. The back-splitting apparatus according to claim 1, further comprising a movable member disposed above the end of the back-splitting station to be engaged by the upper surface sheet of the block of stacked sheets of paper and to be moved when the block of stacked sheets of paper is lifted toward the upper end of the back-splitting station and to be returned to the initial position by the own weight thereof when the stacked sheets of paper is released from the movable member.

3. The back-splitting apparatus according to claim 2, further comprising a first sensor having an opening position and a closing position for detecting the moving distance of said movable member and closing simultaneously upon starting of the moving of said movable member and opening when said movable member moves at a predetermined distance, and a first motor electrically connected to said first sensor so that, when said first sensor opens, said first motor is stopped.

4. The back-splitting apparatus according to claim 3, wherein said operating mechanism comprises a second drive motor which is electrically connected to said first sensor to be driven when said first sensor opens, a driven gear shaft connected to said second drive motor and an eccentric cam secured to said driven gear shaft, said cam being coupled to move said pawl member.

5. The back-splitting apparatus according to claim 4, further comprising a suction pump and a limit switch electrically connected to said suction pump for stopping the suction operation of said suction member, means for actuating said limit switch during the movement of the cutter knife and before the cutter knife separates the block of stacked sheets of paper into a book.

* * * * *

UNITED STATES PATENT AND TRADEMARK OFFICE

CERTIFICATE OF CORRECTION

PATENT NO. : 4,480,517

DATED : November 6, 1984

INVENTOR(S) : EIJI MIYAMOTO

It is certified that error appears in the above-identified patent and that said Letters Patent is hereby corrected as shown below:

Abstract, Line 6, cancel "sides" and substitute therefore ---side---; Col. 1, Line 17, cancel "introduce"; Col. 1, Line 40, cancel "producton" and substitute therefore ---production---; Col. 2, Line 10, after "of" cancel "the"; Col. 2, Line 49, cancel "70" and substitute therefore ---10---; Col. 4, Line 15, cancel "start" and substitute therefore ---drive---; Col. 4, Line 15, cancel "drive" and substitute therefore ---start---

Signed and Sealed this

*Fourteenth* Day of *May 1985*

[SEAL]

*Attest:*

DONALD J. QUIGG

*Attesting Officer* *Acting Commissioner of Patents and Trademarks*